US005558743A

United States Patent [19]

Focke et al.

[11] Patent Number: 5,558,743

[45] Date of Patent: Sep. 24, 1996

[54] PACKAGING MACHINE FOR CIGARETTE PACKS

[75] Inventors: Heinz Focke; Michael Schlenker, both of Verden, Germany

[73] Assignee: Focke & Co. (GmbH & Co.), Verden, Germany

[21] Appl. No.: 315,483

[22] Filed: Sep. 30, 1994

[30] Foreign Application Priority Data

Oct. 12, 1993 [DE] Germany ..... 43 34 745.2

[51] Int. Cl.[6] ..... B32B 31/00; B65B 19/22

[52] U.S. Cl. ..... 156/352; 156/356; 156/378; 156/578; 118/712

[58] Field of Search ..... 156/352, 356, 156/357, 378, 578; 118/663, 712

[56] References Cited

U.S. PATENT DOCUMENTS

| | | | |
|---|---|---|---|
| 3,183,887 | 5/1965 | Derderian . | |
| 3,274,971 | 9/1966 | Beert . | |
| 4,330,354 | 5/1982 | Deubner et al. | 156/352 |
| 4,564,410 | 1/1986 | Clitheros et al. | 156/356 |
| 4,762,578 | 8/1988 | Burgin, Jr. et al. | 156/356 X |
| 5,188,695 | 2/1993 | Colton . | |

FOREIGN PATENT DOCUMENTS

| | | |
|---|---|---|
| 368965 | 11/1982 | Austria . |
| 84442 | 7/1983 | European Pat. Off. . |
| 275887 | 7/1988 | European Pat. Off. . |
| 601411 | 6/1994 | European Pat. Off. . |
| 7148050 | 12/1971 | Germany . |
| 2420816 | 11/1974 | Germany . |
| 3738102 | 5/1989 | Germany . |

*Primary Examiner*—David A. Simmons
*Assistant Examiner*—Paul M. Rivard
*Attorney, Agent, or Firm*—Sughrue, Mion, Zinn, Macpeak & Seas

[57] ABSTRACT

In the production of cigarette packs, glue assemblies (14) having glue nozzles (15) are increasingly used in order to provide with glue pack folding tabs to be adhesively bonded to one another. The glue assemblies (14) or glue nozzles (15) require careful maintenance. For this purpose, the packaging machine is equipped with a maintenance station (16) which allows the necessary manipulations on the glue assemblies (14) in a position convenient for tending purposes. The maintenance station (16) or a holding device (17) is designed in such a way that glue assemblies (14) can be positioned alternatively in a testing position and in a cleaning position.

13 Claims, 4 Drawing Sheets

PACKAGING MACHINE FOR CIGARETTE PACKS

DESCRIPTION

Figure 1:
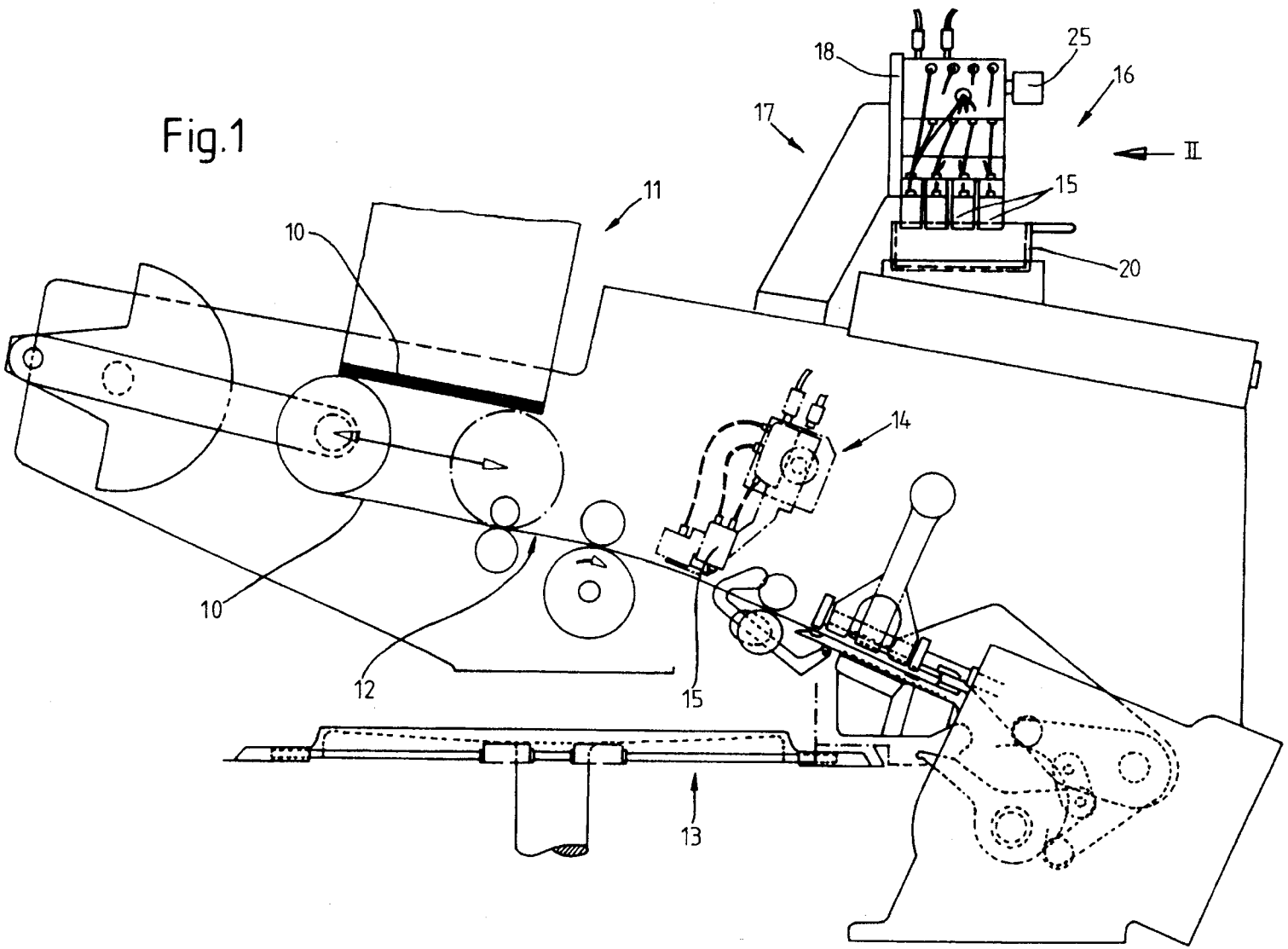

The invention relates to a packaging machine, especially for the production of cigarette packs, with at least one glue assembly for coating glue onto pack folding tabs to be adhesively bonded to one another, each glue assembly having at least one glue nozzle.

As regards packs made from paper, cardboard and similar materials, it is necessary to connect folding tabs to one another by means of glue. The glue is coated onto the folding tabs by special glue assemblies. Glue assemblies equipped with glue nozzles for coating punctiform or linear glue patterns onto the folding tabs have proved especially efficient. In the production of cigarette packs, especially of the hinge-lid type, also, it has recently been proposed to coat the glue onto the folding tabs by means of glue nozzles (DE 42 41 176.9).

In view of the properties of the glue, glue assemblies require special maintenance by attendants. On the other hand, on account of the production cycle, the glue assemblies have to be positioned within the packaging machine in such a way that necessary maintenance and possible repair work can be carried out only at a high outlay and with increased risks for the attendant.

The object on which the invention is based is to design packaging machines with glue assemblies having nozzles, in such a way that the maintenance and, if appropriate, repairs of the glue assemblies can be carried out easily and safely by an attendant.

To achieve this object, the packaging machine according to the invention is characterized in that the glue assembly is attached removably to a working mounting located on the machine, is removed from the latter for maintenance and repair purposes and can be attached to a service mounting in a maintenance station in a region of the packaging machine convenient for tending purposes.

On account of the production cycle, the glue assembly has a predetermined working position within the packaging machine. Although this can be reached by an attendant, it is nevertheless inconvenient and somewhat unsafe for maintenance and possible repair work. In the idea for a solution according to the invention, the glue assembly is removed from the working mounting inconvenient for maintenance and is shifted into a maintenance station. The latter is arranged in such a way that the attendant can carry out the necessary manipulations on the glue assembly safely and comfortably. For this purpose, a special mounting, namely a service mounting, for the temporary reception of the glue assembly is provided in the maintenance station.

After lengthy standstill times and also for other reasons, glue assemblies with glue nozzles require testing in order to ensure that the glue nozzles function perfectly. According to the invention, the maintenance station is designed so that the glue assemblies can be run under operating conditions. The glue assemblies are therefore supplied with glue, compressed air and current in the maintenance station. Glue conduits and compressed-air conduits are therefore designed, according to the invention, in such a way that the glue assembly can be moved between the working position and the maintenance position without an interruption in the supply. According to the invention, a separate connection (plug socket) is provided in the region of the maintenance station on the service mounting for the current supply.

Glue assemblies with glue nozzles have a relatively low deadweight of only a few (for example, three) kilograms. According to the invention, a handle for manual handling, especially a knob of a fastening screw, is attached to the glue assembly. The service mounting is designed so that glue assemblies can be attached in different positions, namely in a cleaning and repair position on the one hand and in a testing position on the other hand. The last-mentioned permits the operating test.

Figure 2:
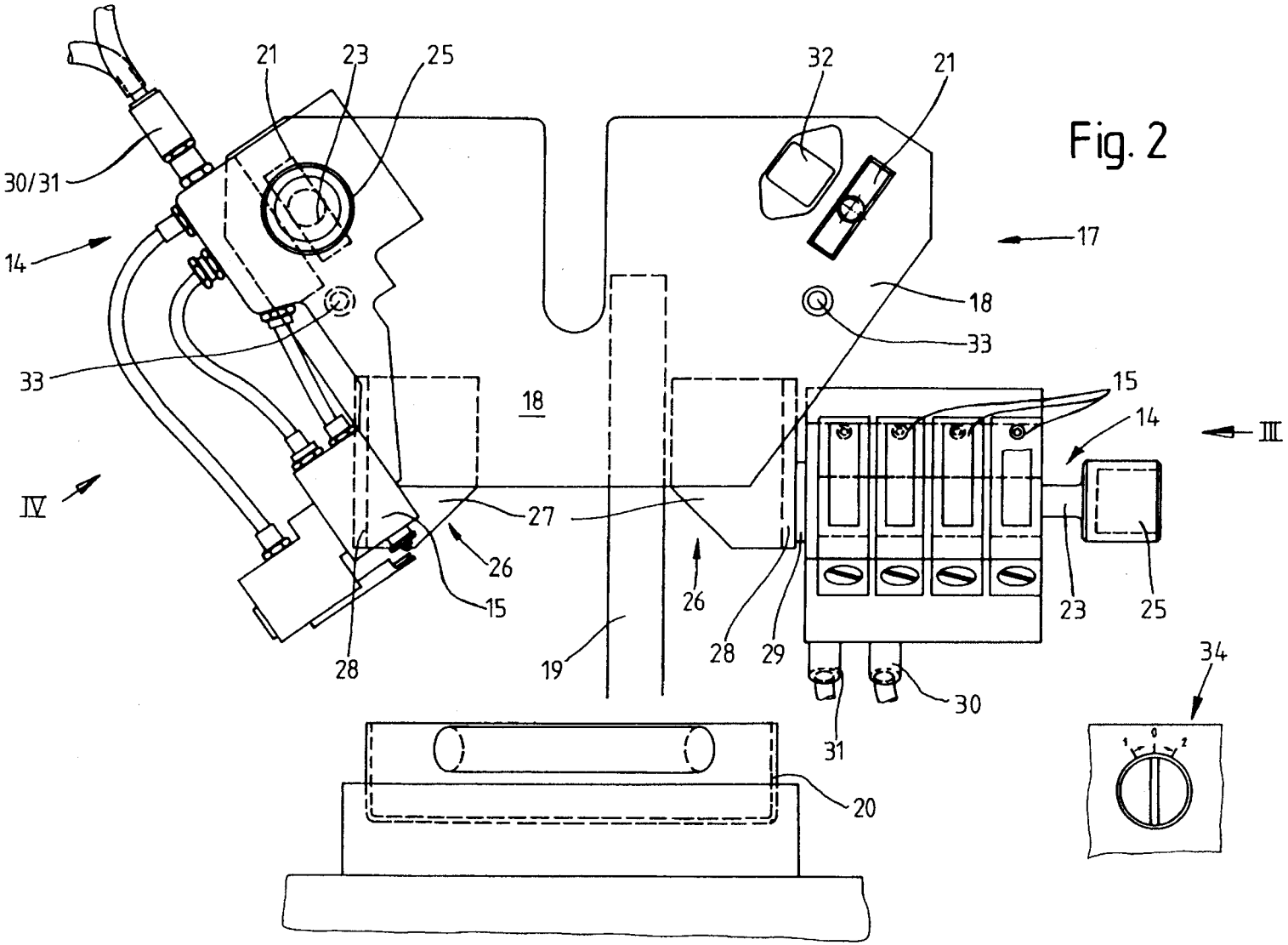
Figure 3:
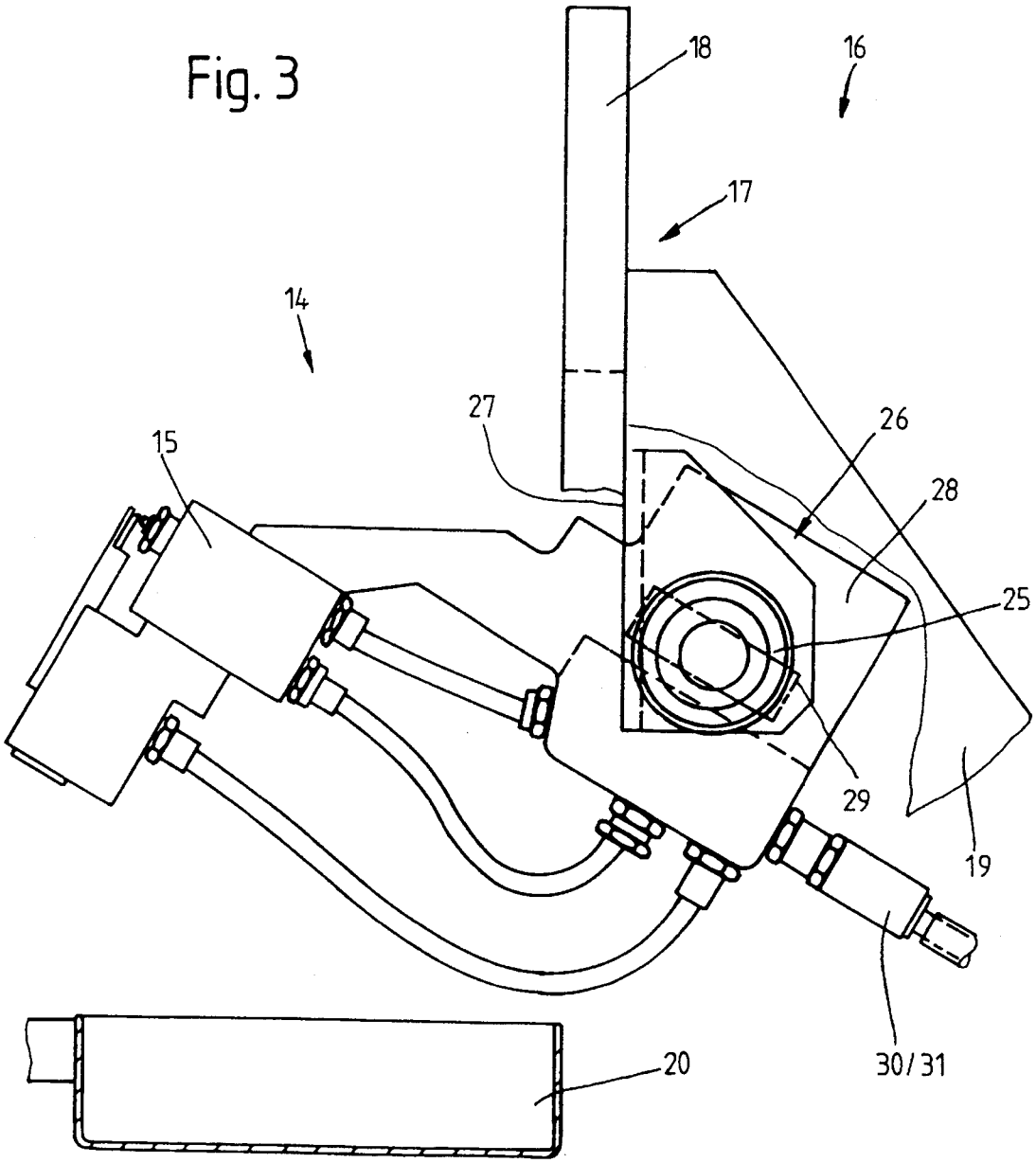
Figure 4:
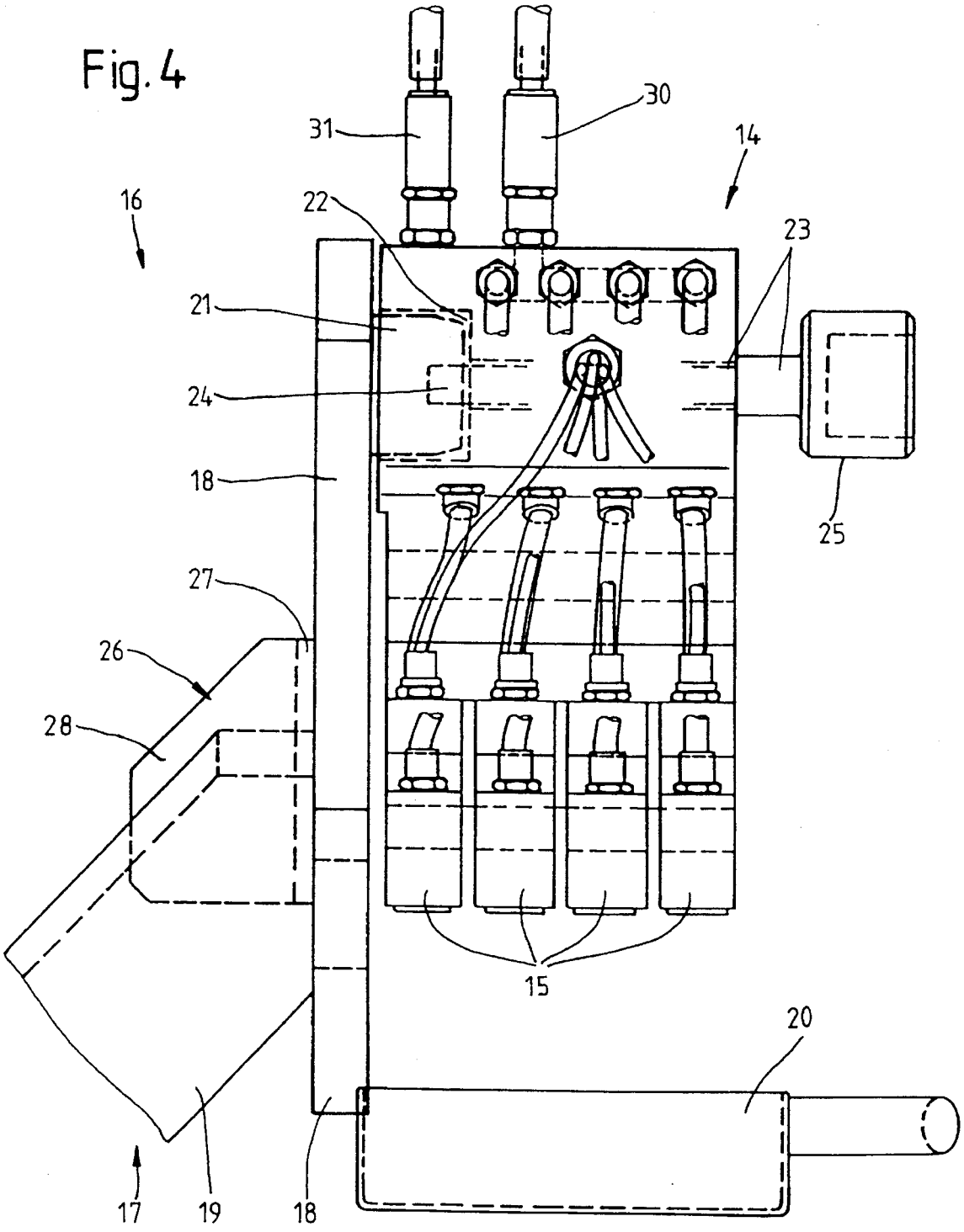

Further particulars of the invention are explained in more detail below by means of an exemplary embodiment illustrated in the drawings. In these:

FIG. 1 shows a part region of a packaging machine in diagrammatic side view, FIG. 2 shows a maintenance station with a mounting for glue assemblies in a front view according to the arrow II in FIG. 1, FIG. 3 shows part of the maintenance station in a side view according to the arrow III in FIG. 2, FIG. 4 shows a glue assembly in a testing position on the service mounting in a view according to the arrow IV in FIG. 2.

FIG. 1 shows as an example of use a part region of a packaging machine for cigarette packs of the hinge-lid type. The packaging machine can correspond to that described and illustrated in U.S. Pat. No. 4,084,393.

In this packaging machine, blanks 10 made from thin cardboard are extracted in succession from a blank magazine 11. The blanks 10 are transported along a blank track 12 into a pushing-in position above a folding turret 13.

Installed in the region of the blank track 12 above the latter is a glue assembly 14. This has the function of coating glue onto folding tabs of the blanks 10. For this purpose, in the exemplary embodiment shown, the glue assembly 14 is equipped with a plurality of (four) glue nozzles 15. Glue is transferred in a punctiform manner onto the blanks 10 by these. In the exemplary embodiment shown, the glue assembly 14 is designed in the same way as or in a similar way to the glue assembly according to DE 42 41 176.9.

In FIG. 1, the glue assembly 14 is shown in a dot-and-dash representation in a working or operating position. The packaging machine is provided, in this region, with a supporting device, from which the glue assembly 14 can easily be removed by an attendant. Particulars of this supporting device are shown in DE 42 41 176.9.

The above-explained working or operating position of the glue assembly 14 is positioned inconveniently for carrying out manual manipulations on the glue assembly 14. The packaging machine is therefore equipped with a maintenance station 16. This has a holding device 17, to which the glue assembly 14 can be fastened temporarily in order to carry out maintenance and repair work. For this purpose, the glue assembly 14 is removed from the holding device assigned to the operating position and is fastened (by hand) to the holding device 17 in the maintenance station 16. The maintenance station 16 is positioned so that the necessary manipulations can be carried out comfortably and, above all, safely on the glue assembly 14 by an attendant. The maintenance station 16 faces a rear side of the machine.

In the exemplary embodiment shown, the holding device 17 consists of a supporting member, namely a support plate 18, on which a plurality of, in the present case two glue assemblies 14—for dual-track operation of the packaging machine—can be positioned simultaneously for maintenance. The support plate 18 is connected to a machine stand of the packaging machine via a stay 19.

A plurality of mountings for the glue assemblies 14 in different relative positions are provided on the holding device 17, namely on its support plate 18. A mounting for receiving a glue assembly 14 for testing purposes is, in each case, provided laterally in the upper region of the holding plate 18. In this position (on the left in FIG. 2), the glue assembly 14 is positioned so that the glue nozzles 15 are directed downwards. The exact relative position is selected so that the glue nozzles 15 point obliquely downwards towards the middle of the holding device 17 and are therefore aligned with a collecting container 20 for glue. In this position, the glue assembly 14 can be run under operating conditions, so that glue emerges from the glue nozzles 15. The glue is intercepted by the collecting container 20.

The mounting for this testing position (FIG. 2 on the left and FIG. 4) consists of a support piece 21 arranged on the support plate 18. This support piece 21 projecting from the support plate 18 on one side penetrates into a depression 22 of approximately the same shape and size as the glue assembly 14. A positive mounting of the latter on the support plate 18 is thereby guaranteed. An anchoring bolt 23 guided through the glue assembly 14 transversely penetrates with a threaded end into the support piece 21. At the opposite end projecting out of the glue assembly 14, the anchoring bolt 23 is provided with a head 25 to be operated by hand. This serves, on the one hand, for grasping and handling or carrying the entire glue assembly 14. On the other hand, the threaded end 24 is anchored in the support piece 21 by rotating the head 25, so that the glue assembly 14 is fixed in an exact relative position on the support piece 21 by means of only a few hand actions. In the present case, according to the desired oblique position of the glue assembly 14, the support piece 21 is attached to the support plate 18 in a corresponding oblique position.

Further (two) mountings, each receiving a glue assembly 14, are formed in the lower region of the support plate 18, specifically likewise laterally. In the present case, these mountings are designed as an angle piece 26. The angle piece is fastened to the support plate 18 by means of a connecting leg 27. A transversely directed supporting leg 28 serves for attaching a glue assembly 14 in a cleaning and repair position. The glue assemblies fixed to the angle piece 26 are located in a position (FIG. 3) in which the glue nozzles 15 are directed obliquely upwards. This is the most convenient position for cleaning and repair work on the glue nozzles 15. In a similar way to the testing position of the glue assemblies 14, the angle piece 26 or its supporting leg is provided with a freely projecting support piece 29 which allows a glue assembly 14 to be attached releasably to the support piece 21 in a similar way. The plane of the supporting leg 28 extends transversely relative to the plane of the support plate 18. As a result, the support pieces 21 and 29 too are directed so that, in the testing position according to FIG. 4, the glue assemblies 14 are rotated through 90° in relation to the cleaning position according to FIG. 3. In the latter, the glue nozzles 15, four in the present case, are located next to one another at the same height, so that cleaning can be carried out easily.

Primarily for testing the glue assembly, a supply of the latter is necessary in the region of the maintenance station 16, specifically at least in the testing position according to FIG. 2 on the left.

A compressed-air conduit 30 and a glue conduit 31 are so designed, namely predominantly consisting of flexible hoses, that, when the glue assembly 14 is being changed from the working position into the maintenance station 16, these connections remain unchanged. The compressed-air conduit 30 and glue conduit 31 are dimensioned appropriately for this purpose.

The current supply can also be designed in the same way, that is to say an electric lead. In the present exemplary embodiment, however, as a better solution the electric lead can be released when the glue assemblies 14 are being changed. For this purpose, a suitable plug is pulled out of a plug socket in the region of the working position and is introduced into a plug socket 32 in the maintenance station 16. In the present exemplary embodiment, this plug socket 32 is arranged directly next to the support piece 21 for the testing position. An electrical supply takes place, here, only in the testing position. During the cleaning of the glue nozzles 15 in the position according to FIG. 3, there is no need for a current supply.

The packaging machine is provided with monitoring members which monitor the presence of glue assemblies 14 in the working position (FIG. 1) and/or in the maintenance station 16. The monitoring device works in that the packaging machine is stopped or cannot start when there is no glue assembly 14 in the working position. In the same way, a testing of glue assemblies 14 can be initiated in the maintenance station 16 only when a glue assembly is located in the maintenance station 16.

For monitoring the presence of glue assemblies 14, contactless sensors 33 attached to the support plate 18 in the maintenance station 16 are provided. These sensors 33 are loaded contactlessly when a glue assembly 14 is inserted into the holding device 17. The effect is such that, after a glue assembly 14 has been inserted into the holding device 17, a switch 34 is activated and, in the case of (manual) actuation, initiates the testing of the glue assembly 14, that is to say particularly the feed of glue.

Sensors which are loaded as a result of the insertion of a glue assembly 14 are similarly arranged in the region of the working mounting located on the machine.

We claim:

1. A packaging machine for the production of cigarette packs, and having at least one glue assembly (14), wherein said glue assembly (14) comprises at least one glue nozzle (15) for directly coating glue onto folding tabs of blanks (10) which are to be adhesively bonded to one another in order to form the packs, and which are transported along a blank track (12);

wherein said machine comprises means for attaching said glue assembly (14) in a working and operating position above the track (12) on a supporting device located on said machine;

wherein said machine comprises, for cleaning and maintenance purposes, a maintenance station (16) containing a holding device (17) in a maintenance station (16), said glue assembly (14) being removable from said supporting device and being fittable in said holding device (17) in said maintenance station (16); and wherein said maintenance station (16) and said holding device (17) are disposed in a position located away from said supporting device and, at the same time, in a region of the packaging machine which is convenient for the cleaning and maintenance operation of the glue assembly.

2. The packaging machine as claimed in claim 1, wherein the holding device (17) in the maintenance station (16) is set for the simultaneous reception of at least two glue assemblies (14).

3. The packaging machine as claimed in claim 2, wherein the holding device (17) in the maintenance station (16)

allows different relative positions of the glue assemblies (14), namely at least one cleaning or repair position, in which the glue nozzles (15) are exposed to a tending side, and at least one testing position in which the glue nozzles (15) are fed with glue and actuated.

4. The packaging machine as claimed in claim 3, further comprising a glue-collecting container (20), and wherein each glue assembly (14) in the testing position is arranged in a correct position above said collecting container (2) for the interception of glue.

5. The packaging machine as claimed in claim 4, wherein glue assemblies (14) in the testing position are attached to the holding device (17) in a position which is directed obliquely downwards in such a way that two glue assemblies (14), which are attached on opposite sides of the holding device (17) point with their glue nozzles (15) in a direction towards the common collecting container (20).

6. The packaging machine as claimed in claim 4, wherein, in the maintenance station (16), the glue assemblies (14), in the cleaning or repair position, are arranged in a relative position offset at 90° in relation to the testing position, with glue nozzles (15) directed obliquely upwards and exposed to the tending side.

7. The packaging machine as claimed in claim 2, wherein the holding device (17), like the supporting device located on the machine, has holding members for the positive positioning of the glue assemblies (14) in a predetermined relative position, said holding members comprising support pieces (21, 29) which penetrate positively into a correspondingly designed recess or depression (22) of each glue assembly (14), the glue assembly (14) being capable of being fastened to the support piece (21, 28) by an anchoring bolt (23) actuable by hand.

8. The packaging machine as claimed in claim 1, further comprising supply conduits, including a compressed-air conduit (30) and/or a glue conduit (31), which lead to the glue assembly (14) and which are designed and arranged in such a way that the glue assembly (14) can be moved out of the working position into the maintenance station (16), with connections of the conduits being maintained.

9. The packaging machine as claimed in claim 1, wherein, the maintenance station (16), separate connections for the supply of current to the glue assembly are formed on the holding device (17).

10. The packaging machine as claimed in claim 3, wherein the holding device (17) of the maintenance section (16) has two differently oriented holding pieces (21, 29) for the different relative positions of each glue assembly, each holding piece being provided for the reception of one glue assembly (14), and wherein the glue assembly (14) is removable from one holding piece (21, 29) and attachable to the other holding piece (29, 21).

11. The packaging machine as claimed in claim 1, wherein said holding device (17) is arranged above the supporting device at a free side of the packaging machine.

12. The packaging machine as claimed in claim 1, further comprising means, including first contactless sensors (33), for monitoring a presence of a glue assembly (14) in said working and operating position, said first contactless sensors (33) being activated in said presence of the glue assembly such that, in the absence of a glue assembly, the packaging machine is stopped.

13. The packaging machine as claimed in claim 12, further comprising a switch (34), and second sensors (33) for monitoring a presence of a glue assembly (14) in the holding device (17) of the maintenance station (16), said second sensors switching on said switch (34) in order to initiate testing of the glue assembly.

* * * * *